US005293997A

United States Patent [19]

Hustad et al.

[11] Patent Number: 5,293,997

[45] Date of Patent: Mar. 15, 1994

[54] RECLOSABLE FOOD PACKAGING HAVING SNAP CLOSURE AND METHOD OF MAKING SAME

[75] Inventors: Gerald O. Hustad, McFarland; Paul E. Grindrod, Madison, both of Wis.

[73] Assignee: Oscar Mayer Foods Corporation, Madison, Wis.

[21] Appl. No.: 855,157

[22] Filed: Mar. 20, 1992

Related U.S. Application Data

[63] Continuation of Ser. No. 673,845, Mar. 20, 1991, abandoned, which is a continuation of Ser. No. 434,921, Nov. 9, 1989, abandoned.

[51] Int. Cl.[5] ..... B65D 13/00

[52] U.S. Cl. ..... 206/467; 206/461; 220/306; 426/106; 426/129; 426/130

[58] Field of Search ..... 383/51, 54, 61, 63; 292/DIG. 38; 402/80 P, 62, 68; 411/339; 206/461, 467

[56] References Cited

U.S. PATENT DOCUMENTS

| | | | |
|---|---|---|---|
| 2,709,290 | 5/1955 | Rosenthal | 220/306 |
| 2,913,140 | 11/1959 | Vuillemenot | 220/306 |
| 3,070,446 | 12/1962 | Seiferth et al. | 426/128 |
| 3,164,478 | 1/1965 | Bostrom | 229/2.5 R |
| 3,311,229 | 3/1967 | Troll et al. | 206/56 |
| 3,342,397 | 9/1967 | Duitsman | 229/2.5 |
| 3,454,158 | 7/1969 | Tigner | 206/78 |
| 3,572,413 | 3/1971 | Livingstone | 220/306 |
| 3,650,386 | 3/1972 | Tigner | 206/46 F |
| 3,792,181 | 2/1974 | Mahaffy et al. | 426/123 |
| 3,833,742 | 9/1974 | Wetmore et al. | 426/129 |
| 3,902,628 | 9/1975 | Schurman | 220/306 |
| 4,498,588 | 2/1985 | Scott | 206/526 |
| 4,498,589 | 2/1985 | Scott et al. | 426/119 |
| 4,512,474 | 4/1985 | Harding | 220/306 |
| 4,576,330 | 3/1986 | Schepp | 229/44 R |
| 4,667,843 | 5/1987 | Galer | 220/354 |
| 4,842,143 | 6/1989 | McKee, Sr. et al. | 206/521.1 |

*Primary Examiner*—Donald E. Czaja
*Assistant Examiner*—Anthony Weier
*Attorney, Agent, or Firm*—Lockwood, Alex, FitzGibbon & Cummings

[57] ABSTRACT

A food package container including a base and a body in alignment with and peelably sealed to each other is provided. At least one of snap closure assembly is provided on the respective peripheral flanges of the base and body, and this snap closure assembly provides an audible snapping signal when the consumer recloses the food packaging container. The closure assembly includes an insertion projection and an opening in general registry therewith which is undersized with respect to the projection.

10 Claims, 2 Drawing Sheets

11
12
13
14
15
17
18
23
24
25

17
21
23
25
27
28
29

11
12
13
14
15
16
17
18
20
21
22
23
24
25
28
29
2

RECLOSABLE FOOD PACKAGING HAVING SNAP CLOSURE AND METHOD OF MAKING SAME

This application is a continuation of application Ser. No. 673,845 filed Mar. 20, 1991 now abandoned which is a continuation of application Ser. No. 434,921 filed Nov. 9, 1989 now abandoned.

DESCRIPTION

BACKGROUND AND DESCRIPTION OF THE INVENTION

The present invention generally relates to food packaging containers and method of forming the containers including locking members for snap locking together a base member thereof and a body member thereof. More particularly, the snap locking members include at least one mating snap closure assembly having a projection on one of the container members which enters into and snappingly engages an undersized opening in the other member of the packaging container. The projection may be subjected to crimping after it has been thermoformed into the package member. An audible snap sounds when the food packaging container is closed by pressing the package base member and body member together. The projection and the undersized opening are formed in the respective peripheral flanges of the base member and body member and at a location that is spaced outwardly from a peelable hermetic seal of the food packaging container.

Food packaging containers of the type that include a semi-rigid and/or thermoformed base member and a body member having a bubble portion for defining a cavity that encloses a food product are well known. Packaging containers of this type have long been used for merchandising packaged foods such as sliced luncheon meats, cheeses and the like. In these types of packaging containers, the food product is hermetically sealed inside the cavity under vacuum packaging conditions in a manner well known in the art. At times, mechanical pressure may be used in order to generally shape or form the food to the package cavity.

A desired objective of many of these types of packaging containers is to provide a food packaging container that is resealable, at least to the extent that the base and body or bubble portion will be readily reclosed after the hermetic seal has been broken and the package has been opened, typically to remove a portion of the food product within the cavity. Attempts in this regard have included the use of pressure sensitive adhesives which remain tacky through a number of openings and closings.

At times, consumers desire a re-securement arrangement that is more readily detectable and more positive-acting. Prior attempts to meet this desire have included various interengaging profiles wherein a component of the base portion generally lockingly engages another component of the body or bubble portion of the food packaging container. These attempts have met with a varied degree of success. One difficulty with some of these structures is the problem of knowing when proper alignment of the interengaging profiles has been achieved so that the interlocking engagement for which the package is designed will be achieved without requiring a great deal of care and attention on the part of the consumer. This can be particularly important for consumers who either do not possess the keen eyesight that might be needed to check that interlocking profiles have been fully engaged. This can also be important in that a typical consumer would like to be assured that the proper degree of interengagement has been achieved by proceeding with what might amount to only casual resealing action, rather than the need to proceed with a studied and careful procedure.

One such approach that can be used in informing the consumer that the designed extent of reclosure has been accomplished is to provide an audible snapping sound which informs the consumer that the package has been reclosed. For merchandising food packaging containers it is essential that any such reclosure means may readily be combined with packaging wherein the packaged foods are formed to the package with vacuum and often also with mechanical pressure.

The present invention responds to a need in the art for food packaging containers which are easily openable and easily reclosable in a positive manner to the extent that the consumer is provided with an audible sound signifying that the package has been reclosed in order to provide at least a perception of freshness preservation. In addition, the reclosing is easily accomplished without requiring close visual study or careful attention by the consumer. This packaging thus provides the consumer with a clear signal that reclosure has been accomplished to ensure that the cavity will not be inadvertently opened and to provide a non-hermetic barrier for retarding deterioration of the food product within the cavity.

In summary, the food packaging container according to the present invention includes a base and a body which together define a bubble enclosure that provides a cavity within which the food product is tightly enclosed. The food is hermetically sealed within the cavity by suitable peelable sealing means. Peripheral flanges of the base and body are positioned outside of the cavity and peelable sealing means, and locking means for snap locking the peripheral flanges together are formed therewithin. The locking means includes at least one closure assembly of a projection and an undersized opening positioned one on the base and the other on the body. The projection and opening are in registry with each other when the base and body are hermetically sealed to each other. After the package has been opened, this registry is easily re-established, at which time the projection enters into the undersized opening, and an audible snap will sound when reinsertion has been accomplished. Preferably, the projection is thermoformed into the package base or body, and it is of an adequate size to allow crimping thereof either before or after filling and sealing of the food packaging container. Post-thermoforming crimping of the projection causes or at least greatly enhances the audible snapping sound which is experienced when the base and body are pressed together.

It is accordingly a general object of the present invention to provide an improved food packaging container and method of forming same.

Another object of this invention is to provide an improved food packaging container and method of forming same, which container incorporates at least one flange area snap closure assembly that effects an audible snap when the food packaging container is reclosed.

Another object of the present invention is to provide an improved food packaging container and method of making same which provide a positive and clear signal to the consumer that the package has been reclosed.

Another object of this invention is to provide an improved food packaging container and method of making same, which container can be readily reclosed without requiring a great deal of time, skill or attention on the part of the consumer, which can be further facilitated by a hinge assembly.

Another object of the present invention is to provide an improved food packaging container and method of making same, which incorporates reclosure members that do not substantially increase the cost of the container and that are readily visible from the front of the container.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 2:
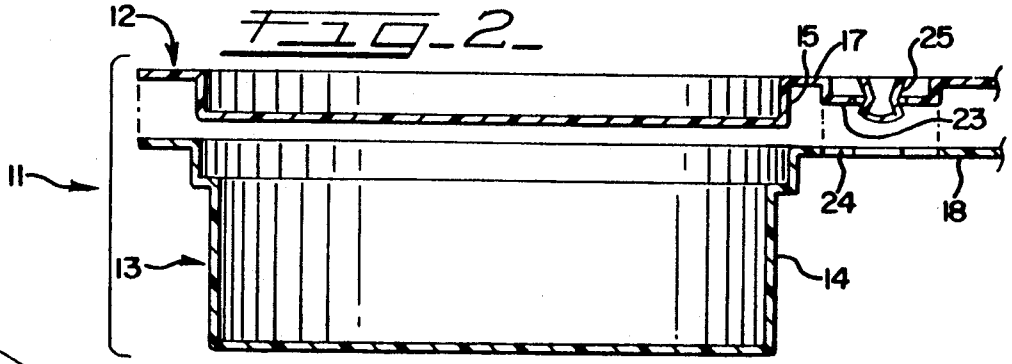
FIG. 2 is an exploded cross-sectional view along the line 2—2 of FIG. 1.
Figure 3:
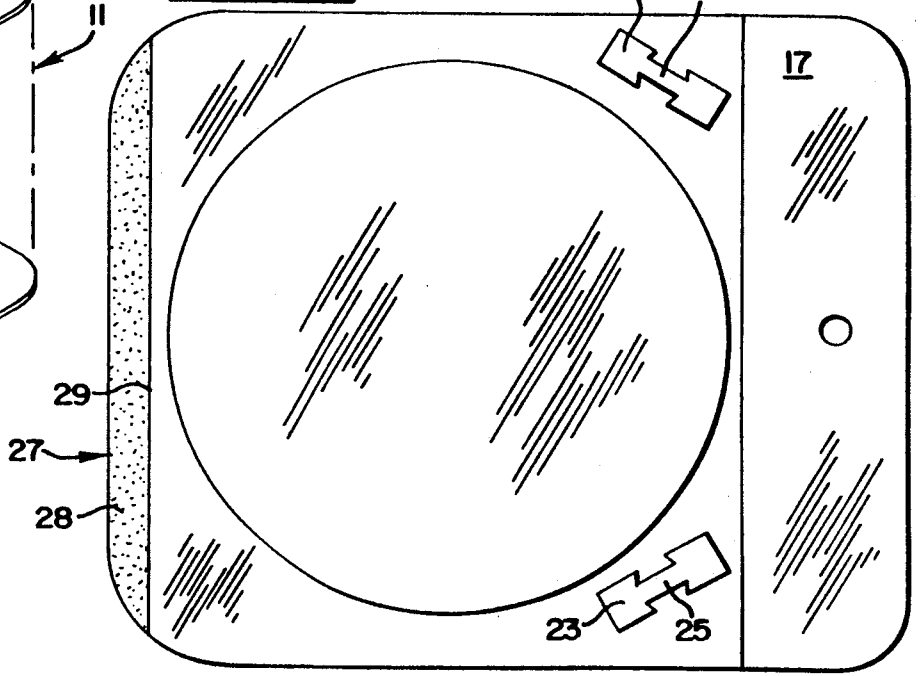
FIG. 3 is a plan view of the base member of the food packaging container shown in FIG. 1.
Figure 1:
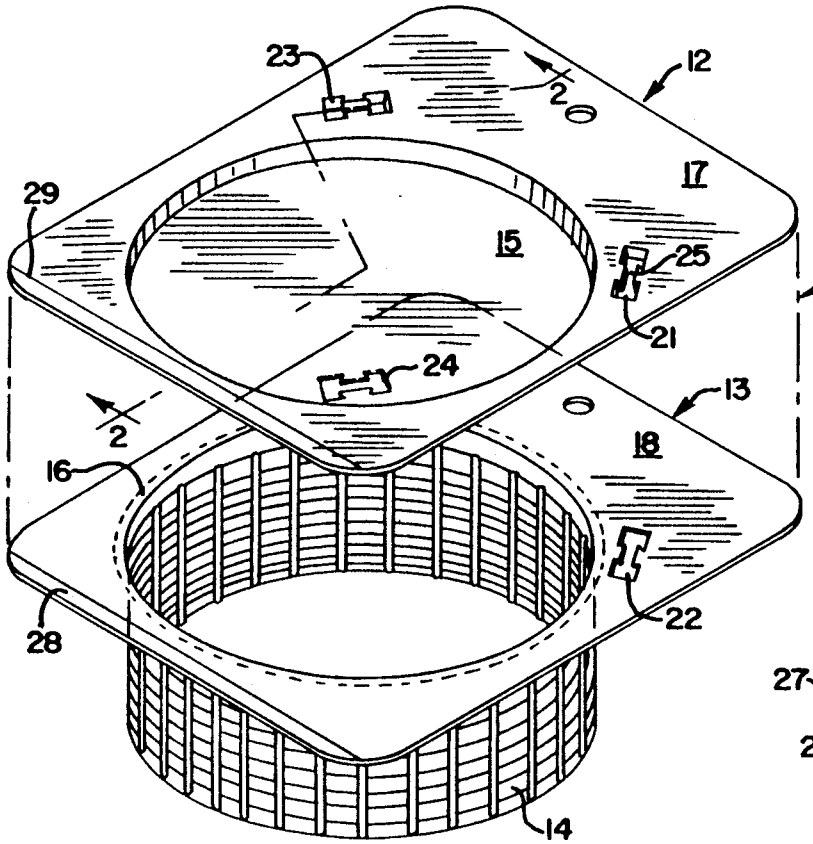
FIG. 1 is an exploded perspective view of a preferred food packaging container according to the present invention.

The food packaging container, generally designated as 11, which is shown in FIGS. 1, 2 and 3 includes a base member, generally designated as 12, and a body member, generally designated as 13. Body member 13 includes a bubble portion 14, and food product such as a stack of luncheon meat or cheese slices or the like (not shown), is tightly enclosed by and between the bubble portion 14 and a panel portion 15 of the base member 12. In this illustrated embodiment, the panel portion 15 takes the form of a pedestal which generally nests within the mouth opening of the bubble portion 14.

A peelable seal 16 is provided, typically in close proximity to the bubble portion 14, and this peelable seal 16 can be of a generally known construction and/or character so that a vacuum seal condition is maintained within the food packaging container 11 until opening thereof is effected. Typically, the peelable seal 16 will be generally along or spaced closely from the inside perimeter of a peripheral flange 17 of the base member 12 and a peripheral flange 18 of the body member 13.

At least one snap closure assembly (two snap closure assemblies being visible in FIG. 1) is provided in the peripheral flanges 17 and 18. In each case, the projection of each snap closure assembly is formed in the base member 12, or the body member 13 and the other undersized opening is formed in the other member. One illustrated snap closure assembly includes base member projection 21 and an undersized opening 22 in the body member. The other illustrated snap closure assembly consists of base member projection 23 and body member undersized opening 24. In this illustrated embodiment, the base member projections 21, 23 are insertion projections, and the body member undersized openings 22, 24 are receptor openings that are generally hollow and closely receive the insertion projections which are generally protruding above the surface of the base member.

Openings 22, 24 are undersized in that each has an opening peripheral size and/or shape so as to effect an interference fit when the base member projection enters the opening. The entry and/or seating of the projection into the opening is accompanied by an audible snap as projection is thus force fitted into the opening. For example, when the perimeter of the opening has the same shape as a cross-section through an engagement portion of the projection, the opening perimeter will be less than the outer perimeter of the projection cross-section, resulting in an audible snap. In those cases where at least an engagement portion of the projection has a cross-sectional shape different from the shape of the opening perimeter, at least a part of the opening will be in interfering engagement with the projection whereby the interfering portions will signal an audible snap when the package is closed. Whichever undersizing approach is utilized, the extent of undersizing must be adequate to achieve the needed force fit, but it should not be so great as to cause the opening or the projection to distort or tear.

The base member 12 and the body member 13 are formed of a semi-rigid, pre-formed plastic material, and the projections 21 and 23 are thermoformed therewithin and at a location at least ⅛ inch away from the cavity area and outside of the peelable seal 16. Each projection has a height which is adequate (typically 1/16 inch or more, typically on the order of approximately ⅛ inch or more) in order to allow for crimping of the projection either before or after filling and sealing of the food packaging container 11. It is preferred that the crimping action be post-thermoforming and before or after the base member 12 and body member 13 are pressed together. The post-thermoforming crimping of the projections can enhance the audible snap which sounds when the body and base are pressed together. The openings can be easily made after thermoforming, for example during a panel cut-out or trimming step.

The projection and opening of this embodiment exhibit a general bowtie shape and provide a relatively large engagement interface and a shape that facilitates crimping the projection, when desired. It can be especially convenient to crimp neck portion 25 of a projection in order to provide especially suitable snap locking means having a reliable audible snap.

Also shown in this embodiment in order to assist in ease of package reclosing is the inclusion of a hinge assembly, generally designated as 27. A suitable hinge assembly 27 can include a permanent-type of glue or adhesive or heat seal 28 for joining respective ends of the base member 12 and body member 13 which are generally opposite from the snap closure assembly. A score line 29 is also preferably included in order to facilitate bending of the semi-rigid base member 12 and/or body member 13.

Figure 4:
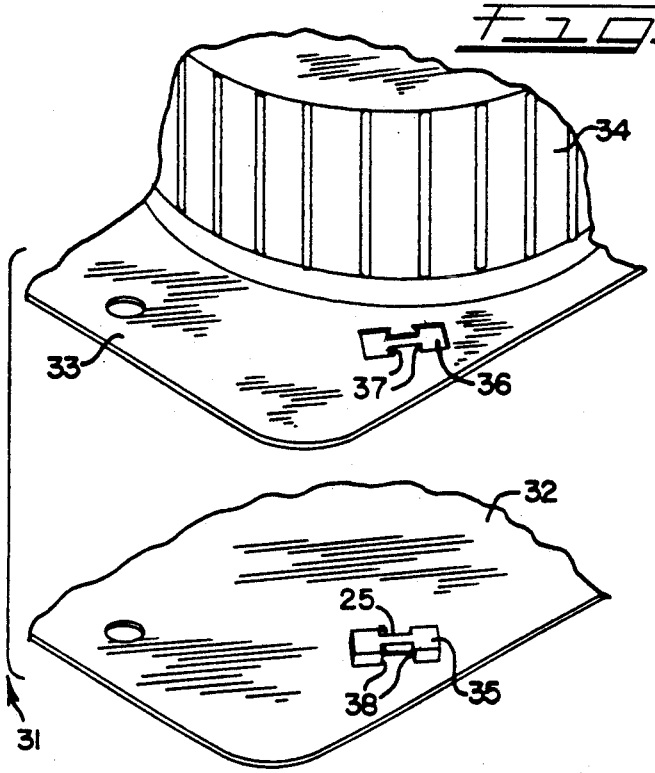
FIG. 4 is an exploded perspective view of an alternative embodiment of a food packaging container according to the present invention.
Figure 5:
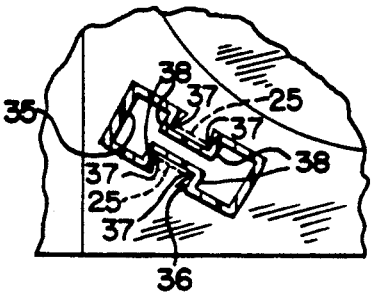
FIG. 5 is a plan cross-sectional view of the locking means, as assembled, of the embodiment illustrated in FIG. 4.

The food packaging container, generally designated as 31 in FIG. 4, includes base member 32 and a body member 33 having a bubble portion 34. In this embodiment, base member projection 35 and body member undersized opening 36 are not entirely identical in shape, and at least one engagement portion of the projection is slightly wider than the opening in at least one location and/or dimension. In the arrangement illustrated in FIGS. 4 and 5, portions of the insertion projection 35 are slightly wider than the generally corresponding portions of the undersized opening 36. The base member projection 35 enters the undersized opening 36 in the body member 33. Totally non-impeded entry is not possible due to the positioning of protruding wings 37 of the undersized opening 36, while corresponding wings are not included in the base member projection 35. By this arrangement, a pinching action is achieved from top to bottom of the projections when the wall 38 slidably engages a protruding wing 37 whereby the protruding wing 37 and/or wall 38 deform to provide secure, pinching engagement therebetween. An audible snap condition can be enhanced by crimping as described in connection with the embodiment of FIGS. 1 through 3, if desired.

Figure 6:
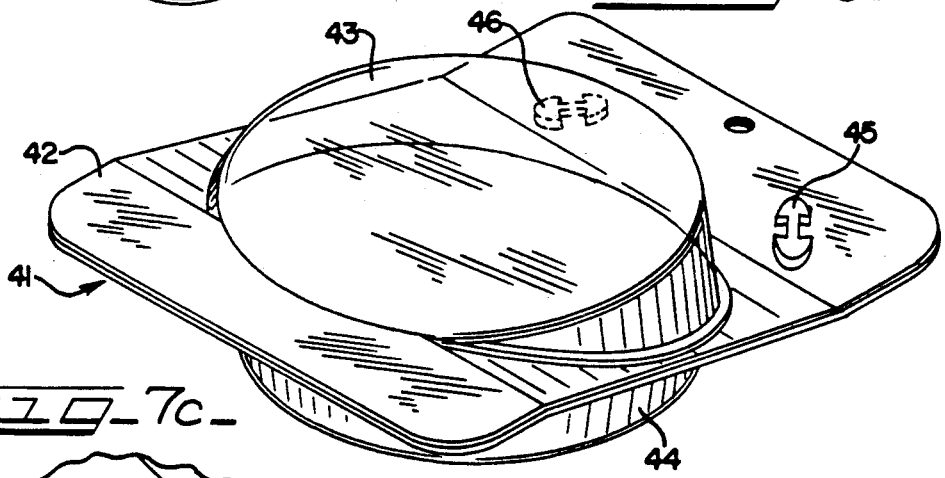
FIG. 6 is a perspective view of another embodiment according to the present invention; and FIGS. *7a*, *7b*, *7c* and *7d* are plan views of other alternative embodiments of locking means for incorporation into food packaging containers according to the present invention.

The FIG. 6 embodiment illustrates another general form which can be taken by a food packaging container, generally designated as 41. In this embodiment, there is less of a delineation between a base member and bubble member. This package provides a substantial hinge arrangement by including a hinge portion 42 joining body members 43 and 44 of generally equal volume. Snap closure assemblies 45 and 46 are illustrated. As with all of the embodiments, these snap closure assemblies can include post thermoforming crimping of the projection and/or can exhibit a pinching action structure. In any event they are characterized by a close interference fit.

In all of the illustrated embodiments, the insertion projection component of each snap closure assembly may be either within the base member or body member, and the corresponding receptor undersized opening component thereof will be within the other member, whether the body member or the base member. A minimum of one such snap closure assembly or as many as six or more such assemblies may be provided in order to achieve the desired reclosable locking action.

Figure 7C:
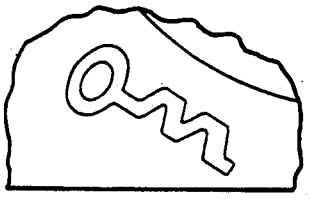
Figure 7A:
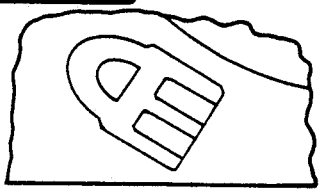
Figure 7B:
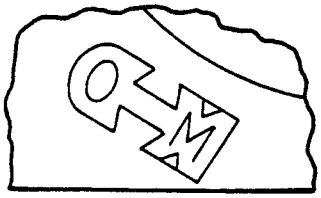
Figure 7D:
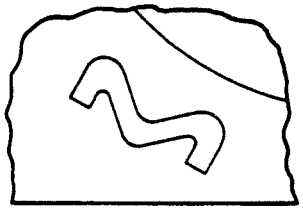

The projections and undersized openings may take on any number of various shapes. Typically these shapes will readily allow for the interference fit, and/or crimping and/or for pinching action as desired. FIG. 7*a* shows a snap closure assembly structure design modeled after a padlock. FIG. 7*b* gives a structure on the order of that shown in the other embodiments, but also resembling a key providing the general outline of initials such as the illustrated "OM". FIG. 7*c* provides another illustration of a multi-faceted shape which approximates that of the initials "OM". FIG. 7*d* illustrates another shape of projection and undersized opening.

With more particular reference to the method aspects of this invention, U.S. Pat No. 3,498,018, No. 4,411,122, No. 4,577,757 and No. 4,688,369, which are incorporated by reference hereinto, describe methods of forming a vacuumized, hermetically sealed package characterized by a predetermined quantity of product which is deformable and is arranged in the form of an upright mass on a pedestal having a sidewall and a peripheral flange for hermetic sealing to a corresponding peripheral flange of the body member. The food product will engage the end panel of the body member bubble, as well as its sidewall. The sidewall of the base panel pedestal telescopes into the bottom edges of the bubble sidewall.

In a typical method for filling this type of package, the body member is placed in an inverted position, such as generally illustrated in FIG. 1 hereof, and sufficient quantity of product is placed thereinto so that the cavity will be substantially filled when the package is assembled. Then, the base member is positioned on the mouth of the bubble so that the pedestal telescopes into the bubble and engages the product. The flange margins of the base member overlie the corresponding margins of the body member. Mechanical pressure can be applied inwardly and onto the outside surface of the pedestal. The area defined by the bottom edges of the bubble sidewall can be sufficient to force the product into close contact with interior surfaces of the base and body members t shape the product to conform to the shape of the cavity and substantially completely fill the space between the cavity and product while vacuumizing the assembly and while sealing the package in a hermetic manner.

The projection or projections are formed in the desired peripheral flange, preferably by thermoforming. While crimping can be accomplished before or after filling and sealing of the package, it is preferred to crimp before the base member and body member are assembled together. An audible snap is enhanced by post-thermoforming crimping of neck portions or the like of the projection or projections.

When this invention is followed, reclosability and the ability of the package to then stay closed is achieved at low cost by providing one or more points of frictional interaction outside of the sealed area of the package. An audible snap sound is also provided which enhances the perception of freshness preservation once the package is opened. This invention can be applied to packages of any of various shapes, including those that are generally round and generally square or rectangular, and the bubble portions can take on needed product-conforming shapes. Also, the projection or projections are readily visible to the consumer, even from the front of the package, and they can present a pleasing appearance. To achieve easy opening of the peelable seal, high molecular weight polymer adhesives which are peelable and resealable may be used, or easy peel multi-layer rigid films that are heat sealable may be used.

With more particular reference to the preferred crimping procedure, crimping of the projection or projections occurs by applying pressure to one or both sides of the projection (or a portion of it such as the illustrated neck) in order to slightly deform it. Crimping might occur at room temperature, or heat may be applied to the surface of the crimped area and/or imparted thereto by the crimping device itself, in order to utilize solid state forming techniques.

In a typical food pack aging container, the thickness of the bubble film is about 13 ml. and the thickness of the base film is about 10 ml. Exemplary bubble compositions include Barex 210 or polyethylene terephthalate. A suitable base composition can be Barex 210, polyvinyl chloride, or Saranex laminated to Barex 210 or polyvinyl chloride or polystyrene.

It will thus be seen that the present invention provides new and useful food packaging containers and method for making same, which have a number of advantages and characteristics, including those pointed out herein and others which are inherent in the invention. Preferred embodiments have been described by way of example, and it is anticipated that modifications may be made to the described form without departing from the spirit of the invention or the scope of the appended claims.

What is claimed is:

1. A food packaging container, comprising:

a base member having a panel portion for supporting a food product and a peripheral flange portion generally surrounding said base member panel portion;

a body member having a bubble portion for cooperating with the base member panel portion to define a cavity to fully enclose the food produce therewithin, said body member further including a peripheral flange portion generally surrounding said body member bubble portion;

peelable sealing means to provide hermetic sealing of the base member peripheral flange portion to the body member peripheral flange portion after the food product is filled into the cavity, said peelable sealing means providing a perimeter that is generally closely spaced outside of said cavity;

locking means for snap locking said base member to said body member, said locking means including at least one closure assembly, said closure assembly including an insertion projection having a perimeter with a defined perimeter shape and an undersized opening having a perimeter shape which is generally the same as said defined perimeter shape of the insertion projection and which is undersized with respect to at least a part of said insertion projection perimeter, said insertion projection having been thermoformed into one of said base member peripheral flange or said body member peripheral flange, said thermoformed insertion projection having a surface spaced away from said peripheral flange and a sidewall joining said spaced surface and said peripheral flange, said undersized opening being in the other of said body member peripheral flange or said base member peripheral flange, said insertion projection and said undersized opening being in insertion interengagement registry with each other at a location outside of said peelable sealing means, and said undersized opening receives and enters into interference fit snapping engagement with said insertion projection;

said sidewall of the insertion projection includes a post-thermoformed crimped portion which was formed by crimping said sidewall of said insertion projection after said projection has been thermoformed, said post-thermoformed crimped portion being an indent within said sidewall of the insertion projection, said spaced away surface of said insertion projection has a peripheral size greater than the periphery of the undersized opening through which the spaced away surface passes during snap locking, whereby said spaced away surface and said periphery of the undersized opening interfere with each other during snap locking movement of the food packaging container, and said indent of the insertion projection sidewall has a peripheral size not greater than said periphery of the undersized opening, whereby said indent and said periphery of the undersized opening do not interfere with each other when said food packaging container is snap locked;

said undersized opening has a protruding wing portion which is generally perpendicular to said sidewall of the insertion projection and which engages said sidewall at a corresponding location thereof, said corresponding location being other than at said indent, said protruding wing portion deforms to provide pinching securement action when said closure assembly is joined together, said protruding wing portion providing an opening portion which is slightly narrower than said corresponding location of the insertion projection sidewall whereby said protruding wing portion and corresponding location of the sidewall slidably engage each other to deform said protruding wing portion or said corresponding location of the sidewall to provide said pinching securement action therebetween during movement of the insertion projection into the opening before snap locking and when said insertion projection is snap locked; and said closure assembly provides for reclosure of the food packaging container, which reclosure is signalled by an audible snapping sound generated by reinsertion of said insertion projection into said undersized opening and engagement of said post-thermoformed crimped portion with said undersized opening.

2. The food packaging container according to claim 1, wherein said projection has a general bowtie shape along said peripheral flange portion, and said crimped portion is a crimped central neck portion.

3. The food packaging container according to claim 1, wherein said base member panel portion is a protruding pedestal having an annular sidewall that nests within said bubble portion of the body member.

4. The food packaging container according to claim 1, further including hinge means hingedly joining an edge of said base member peripheral flange portion and an edge of said body member peripheral flange portion.

5. The food packaging container according to claim 1, further comprising:

hinge means for hingedly joining an edge of said base member peripheral flange portion and an edge of said body member peripheral flange portion at a location generally opposite to the location of said locking means.

6. A method of forming a food packaging container and assembly for closure of the container, said method comprising the steps of:

thermoforming a base member having a panel portion for supporting a food product and a peripheral flange portion generally surrounding said base member panel portion;

at least one of said thermoforming steps including thermoforming an insertion projection into the peripheral flange portion of one of said base member or said body member, said insertion projection having a defined perimeter shape, a surface spaced away from said peripheral flange portion and a sidewall joining said spaced surface and said peripheral flange;

thermoforming a body member having a bubble portion for cooperating with the base member panel portion to define a cavity to fully enclose the food product therewithin, said thermoforming step further including forming a peripheral flange portion surrounding said body member bubble portion;

forming an undersized opening into the peripheral flange portion of the member other than the one having the insertion projection, said undersized opening having a periphery, at least a portion of which is smaller than a similarly positioned portion of said insertion projection, said periphery of the undersized opening having a shape which is generally the same as said defined perimeter shape of the insertion projection;

forming a post-thermoformed crimped portion of said previously thermoformed projection by crimping said sidewall of said insertion projection after said step of thermoforming the insertion projection, said crimping step forming an indent to narrow the sidewall of the insertion projection to a peripheral size not greater than that of the periphery of the undersized opening while the spaced away surface of the insertion projection is formed of a peripheral size greater than the periphery of the undersized opening;

forming a protruding wing portion in one of said insertion projection or undersized opening which is at a location other than said indent and generally perpendicular to the sidewall of the insertion projection when the food packaging container is closed to provide a portion which is slightly narrower than a corresponding portion of the other of said insertion projection or undersized opening;

hermetically sealing together a portion of said base member peripheral flange and a portion of said body member peripheral flange to provide a peelable seal along a perimeter that is closely spaced outside of said cavity; and inserting said thermoformed insertion projection into said undersized opening in order to snap lock said projection and opening together to provide a closure assembly for reclosure of the food packaging container, which reclosure is signalled by audible snapping sound generated by reinsertion of said insertion projection into said undersized opening and engagement of said post-thermoformed crimped portion with said undersized opening, said inserting step including interference engagement between the spaced away surface of the insertion projection and the corresponding portion of the undersized opening, said inserting step further including slidable engagement between the protruding wing portion on said one of said insertion projection and said opening and the corresponding portion of the other of said insertion projection and opening to deform the protruding wing portion or the corresponding portion on said insertion projection both during movement of the insertion projection into the opening before snap locking and when said insertion projection is snap locked in said opening.

7. The method according to claim 6, wherein said crimping step takes place before said inserting step.

8. The method according to claim 6, wherein said undersized opening forming step includes forming a protruding portion of said undersized opening.

9. The method according to claim 6, further including hingedly attaching together respective ends of said peripheral flange portions.

10. The method according to claim 6, wherein said hermetic sealing step is preceded by filling said cavity with a food product.

* * * * *

UNITED STATES PATENT AND TRADEMARK OFFICE

CERTIFICATE OF CORRECTION

PATENT NO. : 5,293,997

DATED : March 15, 1994

INVENTOR(S) : Gerald O. Hustad and Paul E. Grindrod

It is certified that error appears in the above-indentified patent and that said Letters Patent is hereby corrected as shown below:

Col. 6, line 17, "t shape" should read --to shape--; lines 54-55, delete --in order to utilize solid state forming techniques--; line 56, "pack aging" should read --packaging--.

Col. 7, line 13, "produce" should read --product--.

Signed and Sealed this

Twenty-second Day of November, 1994

*Attest:*

Bruce Lehman

BRUCE LEHMAN

*Attesting Officer*

*Commissioner of Patents and Trademarks*